United States Patent [19]

Kelsey et al.

[11] 4,057,990

[45] Nov. 15, 1977

[54] BENDER ROLL GUARD

[75] Inventors: Amos P. Kelsey, Hamburg; John A. Palumbo; James L. Thiel, both of Lackawanna, all of N.Y.

[73] Assignee: Bethlehem Steel Corporation, Bethlehem, Pa.

[21] Appl. No.: 755,417

[22] Filed: Dec. 29, 1976

[51] Int. Cl.[2] ..... B21D 55/00

[52] U.S. Cl. ..... 72/166; 74/609

[58] Field of Search ..... 72/166–175; 74/612, 616, 613, 609

[56] References Cited

U.S. PATENT DOCUMENTS

| | | | |
|---|---|---|---|
| 1,146,547 | 7/1915 | Bishop | 72/175 |
| 3,364,711 | 1/1968 | Noudgren | 72/169 |

*Primary Examiner*—Milton S. Mehr

*Attorney, Agent, or Firm*—Joseph J. O'Keefe; Michael J. Delaney; Anson W. Biggs

[57] ABSTRACT

A protective shield for the bite between a pair of coacting rolls in a bending machine. The shield includes a guard positioned to contact and surround one of the rolls so that rotation of the roll causes the guard to rotate and shield the bite between the rolls.

5 Claims, 4 Drawing Figures

BENDER ROLL GUARD

BACKGROUND OF THE INVENTION

This invention relates generally to guards or shields for protecting operating personnel from contacting moving mechanical parts of machinery and more particularly to shielding rotating rolls in a bending machine.

Machines for bending a metal workpiece, i.e., structural sections, plates, etc., comprise coacting rotating rolls. The rolls are separted to form a bite into which the workpiece is introduced. Friction between the workpiece and the driven rolls causes the workpiece to be advanced through the gap or separation between the rolls to perform the desired operation on the workpiece. The bite area between the rolls is frequently unprotected against the accidental contact with operating personnel and/or their clothing.

A particular type of machine for forming metal plates into cylindrical articles as e.g. tank sections comprises three parallel rolls. Two of the rolls are disposed side by side and spaced apart. The third roll is disposed above the two lower rolls midway between them. The bite into which a plate is introduced is formed by the separation between the upper roll and one of the lower two rolls on the entry side. Plate bending machines are usually of substantial width having rolls greater than 6 feet in length. The exposed roll bite area is therefore quite extensive, presenting a hazard to operating personnel. Bending machines of this type have generally been void of protective shields.

SUMMARY OF THE INVENTION

It is an object of this invention to provide protective shielding for rotating rolls.

It is another object of this invention to provide apparatus that protects the bite area between rotating coacting rolls from accidental contact therewith by objects or operating personnel.

It is a further object of the invention to provide self-adjusting apparatus for shielding rotating rolls.

The invention accomplishes these objects by providing a guard positioned to contact and surround a portion of a rotating roll. Means is provided to rotate the guard in the direction of the rotation of the roll and to limit such rotation as desired so that the bite created between the roll and the workpiece is completely guarded.

DESCRIPTION OF THE PREFERRED EMBODIMENT

Figure 1:
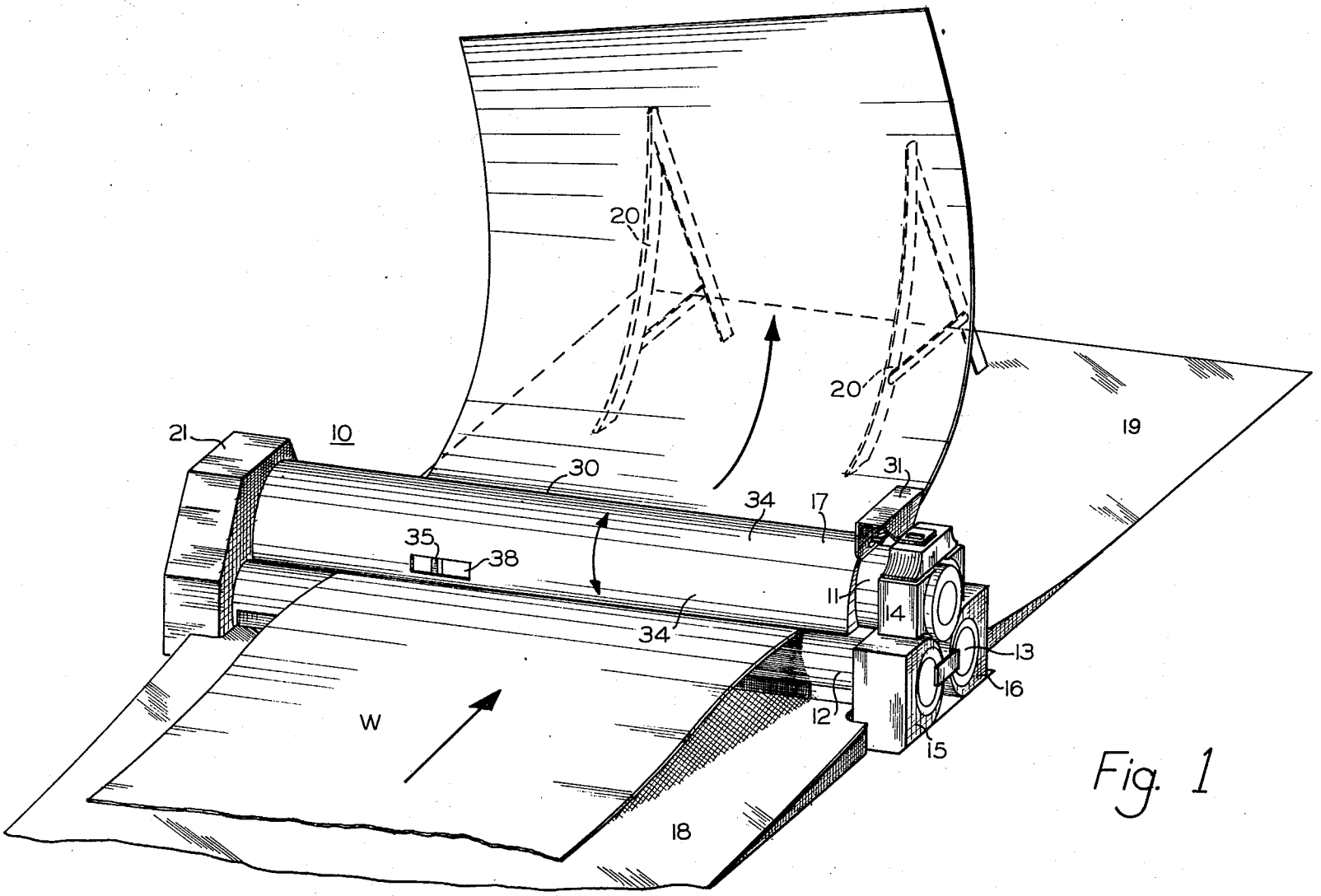
FIG. 1 is an isometric view of a plate bending machine incorporating the instant invention seen from the entry side of the machine.
Figure 2:
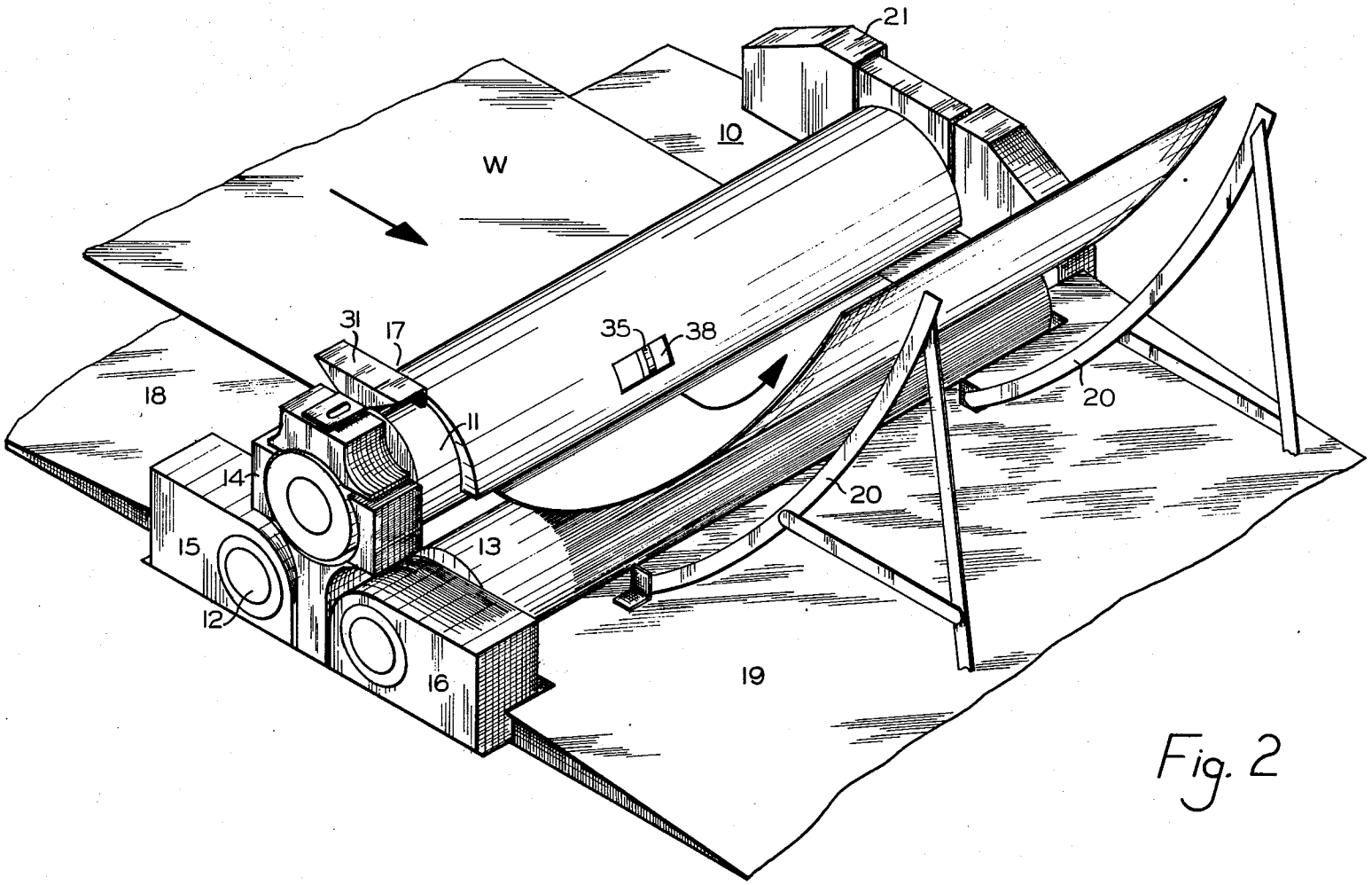
FIG. 2 is an isometric view of the machine of FIG. 1 seen from the exit side of the machine.

Referring now to the drawings for a detailed description of the invention and particularly to FIGS. 1 and 2, a plate bending machine 10 is seen which comprises generally upper roll 11, lower rolls 12 and 13, bearing blocks 14, 15 and 16, protective shield 17, entry side table 18, exit side table 19 and guide rack 20. Rolls 11, 12 and 13 are supported in bearing block 14, 15 and 16 respectively and are driven by drive means (not shown) in housing 21.

Figure 3:
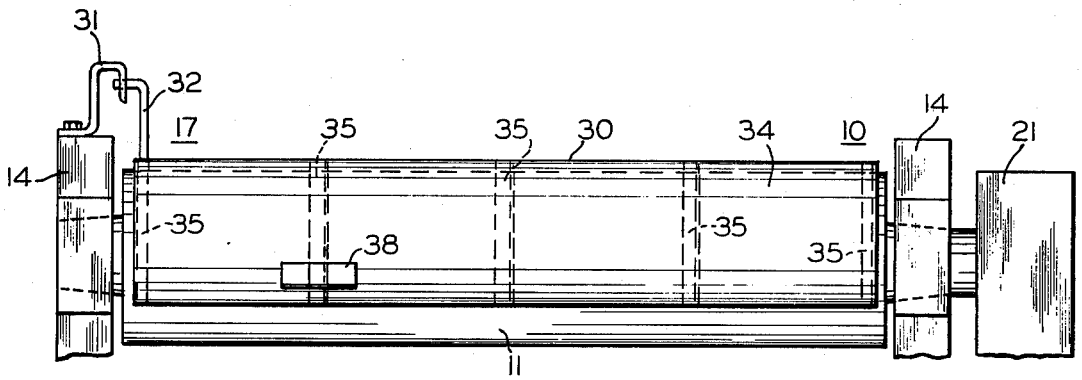
FIG. 3 is a side View of the upper roll of the bending machine incorporating the shield of the instant invention.

FIG. 3 is a side view of the upper roll incorporating the protective shield 17 of the instant invention and shown in the neutral position. Some details of the bending machine 10 including the lower rolls 11 and 12 have been removed for clarity.

Figure 4:
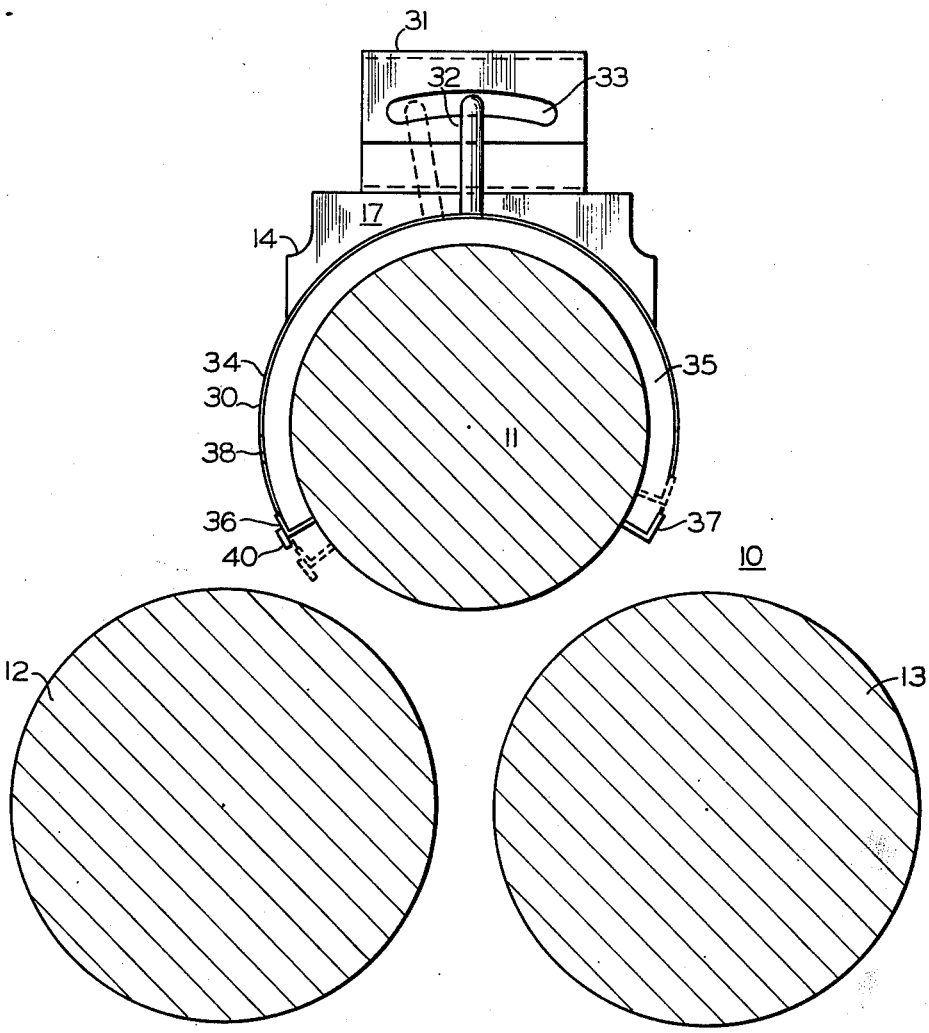
FIG. 4 is a sectional view through the three-roll plate bending machine showing the shield of the instant invention on the upper roll of the machine.

FIG. 4 is a transverse sectional view of the bending machine 10 with the protective shield 17 shown in the neutral position with the closed position of the shield shown in phantom protecting the bite area between rolls 11 and 12. As in FIG. 3, portions of the machine are removed for clarity.

The protective shield 17 as seen in FIGS. 3 and 4 comprises a guard 30 positioned to surround and contact a portion of one of the rolls, a guide plate 31 adjacent the guard 30 and a guide rod 32 attached to the guard 30 and in contact with guide plate 31. Guide rod 32 projects through slot 33 in guide plate 31 to limit the rotation of guard 30 upon rotation of upper roll 11. Guide plate 31 as seen in FIG. 3 is rigidly attached to bearing block 14. The guard 30 surrounds approximately 240° of the roll and is substantially in contact with the roll. Clearance for sliding the guard lengthwise on and off of the roll is provided, of course.

Guard 30 comprises a light gauge metal sheath 34 covering a plurality of arcuate ribs 35 which have an inner radius substantially the same as the radius of the roll on which the guard is applied. The inner surface of the arcuate ribs 35 rests on the surface of roll 11. Thus, guard 30 is rotated with the rotation of roll 11 by the friction between the inner surface of the arcuate ribs 35 and the roll surface, within the limits of movement of guide rod 32 in slot 33 of guide plate 31. A rectangular opening 38 may be provided in the metal sheath 34 as a viewing port for the operator of the bending machine.

The sheath 34 and arcuate ribs 35 terminate at and are attached to terminal pieces, e.g. angles 36 and 37, which terminal pieces provide the extremities of the protective shielding in contact with the plate being processed through the bending machine 10.

Angles 36 and 37 may be replaced with flat plates as the terminal pieces if desired.

An alternative embodiment as seen in FIG. 4 includes a strip 40 of flexible material, as e.g. premolded felt or other suitable material attached to the terminal pieces, e.g. angles 36 and 37 of the roll guard 30 and extending below the angles 36 and 37 to contact the surface of the metal plate workpiece in the machine. It is understood that roll 11 can be driven in either direction and therefore it is clear that the strip 40 is applicable to either or both of the terminal pieces, e.g. angles 36 and 37. The strip 40 has the advantage of wiping the workpiece so that chips or pieces of metal are swept away from contact with the rolls.

In operation: a machine 10 for bending metal plate W comprises a plurality of coacting rolls, i.e., upper roll 11 and lower rolls 12 and 13. The machine includes an entry side table 18 and exit side table 19. Guide rack 20 may be used if desirable. Workpiece or plate W is maneuvered for entry into the bite between upper roll 11 and either lower roll 12 or 13 depending on the direction of rolling. The operator is able to align the edge of the plate to the rolls by sighting through the rectangular opening 38 provided in the sheath 34. The rolls are caused to rotate and as the rotation commences the friction between the arcuate ribs 35 which support the metal sheath 34 causes the protective shield 17 to rotate also within the limits of movement of guide rod 32 in the slot 33 in guide plate 31. The slot can be designed to limit the rotation of angles or terminal pieces 36 and 37 to a position just above the plate workpiece W or the angles or the edge strip 40 can be allowed to ride on the plate workpiece. The guard adjusts itself according to the thickness of the workpiece and within the limits of slot 33.

Heavy expanded metal could be used in place of the light gauge metal sheath 34 to permit full view of the plate and roll during rolling.

As noted above, friction between the roll and the arcuate ribs of the guard creates the closing action. The apparatus of the preferred embodiment shown in the Figures uses the weight of the guard to create this friction.

We claim:

1. A protective shield for the bite between a pair of coacting rolls comprising a. a guard rotatably mounted adjacent to and surrounding a portion of one of the rolls and in frictional contact therewith, b. a guide plate located adjacent said guard, and c. a guide rod attached to said guard and in contact with said guide plate with means to limit the rotation of said guard upon rotation of said one of the rolls.

2. In a machine for bending metal plate including a plurality of coacting rotating rolls and having an entry side and an exit side with means for supporting the metal plate prior to entering the entry side and means for guiding the metal plate on the exit side, the improvement comprising:

a roll guard rotatably mounted in frictional contact with a portion of one of the coacting rolls so that the roll guard is rotated in the direction of and by the rotation of the one of the coacting rolls to shield the bite area of the rolls.

3. In a machine for bending metal plate according to claim 2 wherein the roll guard is self adjusting.

4. In a machine for bending metal plate according to claim 2, wherein the roll guard comprises a plurality of arcuate ribs covered by a sheath and a rod fixed to one end of the roll guard, the rod extending into a guide plate attached to the housing of the machine to limit the rotation of the guard.

5. In a machine for bending metal plate according to claim 4 the improvement further comprising a strip of flexible material attached to the roll guard to contact the surface of the metal plate.

* * * * *